United States Patent [19]

Best et al.

[11] 4,294,089

[45] Oct. 13, 1981

[54] LATCHBOLT RIM LOCK

[75] Inventors: Walter E. Best; William R. Foshee, both of Indianapolis, Ind.

[73] Assignee: Best Lock Corporation, Indianapolis, Ind.

[21] Appl. No.: 965,185

[22] Filed: Nov. 30, 1978

[51] Int. Cl.[3] ..... E05B 55/00

[52] U.S. Cl. ..... 70/150; 70/151 A; 70/448; 70/462; 70/DIG. 6; 292/169.18

[58] Field of Search ..... 70/145, 150, 151 R, 70/151 A, 448, 462, DIG. 6; 292/169.14, 169.18, 169.13, 165, 145

[56] References Cited

U.S. PATENT DOCUMENTS

| | | | |
|---|---|---|---|
| 168,986 | 10/1875 | Griscom | 292/245 |
| 227,301 | 5/1880 | Reinhart | 70/462 |
| 2,136,539 | 11/1938 | Brinton | 70/151 R X |
| 2,279,591 | 4/1942 | Heyer | 70/151 X |
| 2,379,810 | 7/1945 | Ledin et al. | 70/DIG. 6 X |
| 2,656,207 | 10/1953 | Russell et al. | 70/151 R X |
| 2,787,155 | 4/1957 | O'Connell | 70/151 R |
| 3,211,486 | 10/1965 | Crandell | 70/151 R X |
| 3,337,250 | 8/1967 | Russell et al. | 70/151 A X |
| 3,361,464 | 1/1968 | Foster | 292/245 |
| 3,971,239 | 7/1976 | Lavis | 70/448 X |

FOREIGN PATENT DOCUMENTS

| | | | |
|---|---|---|---|
| 236446 | 11/1961 | Australia | 70/150 |

*Primary Examiner*—William E. Lyddane
*Attorney, Agent, or Firm*—Jenkins, Coffey, Hyland, Badger & Conard

[57] ABSTRACT

A latchbolt rim lock of simple sturdy construction with smooth effective operation and long life. A die cast case forms guides for a bolt having a head and draw plate, and has U-shaped ribs on its rear wall to define seats for springs biasing the bolt forward, in which the springs are held by a rear flange on the back plate. A rearward boss on the front wall forms a retraction stop for the bolt and contains a headed holdback plunger which is manually movable into a hole in the bolt where it is latched by its head to hold the bolt retracted. The draw plate contains a cam opening which defines opposite cam faces which are engaged by a crank pin to retract the bolt. The cam opening also has a central pin-passing throat which allows cammed retraction of the latchbolt relative to the crank pin, and defines supplemental cam faces for moving the bolt to release the holdback plunger. For deadlocking the latchbolt, an auxiliary bolt is mounted beside the latchbolt and biased to projected position by a spring mounted on the case. The bolt is connected to be retracted with the latch bolt, but to be held retracted by a strike while the latchbolt is projected. A bell crank lever pivoted on a post of the case has a blocker arm movable into and out of the path of the bolt head, respectively to block and permit its retraction, and has a control arm by which the lever is swung to retraction-permitting position when the auxiliary bolt is projected. When the auxiliary bolt is retracted, the control arm swings against the crank pin so as to be cammed to retraction-permitting position when the crank pin is manually actuated to retract the bolt. To permit changing the hand of the lock, the bolt is made symmetrical except for the bevel on its head so that it can be turned over in the case, and the auxiliary bolt head is mounted for rotation on a draw bar to reverse the position of its bevel face.

16 Claims, 11 Drawing Figures

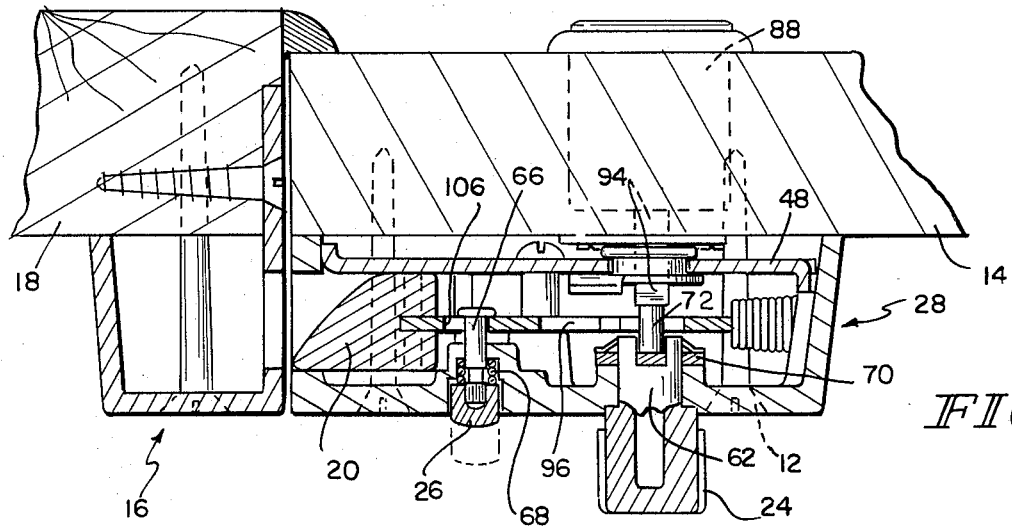
FIG. 6
FIG. 7
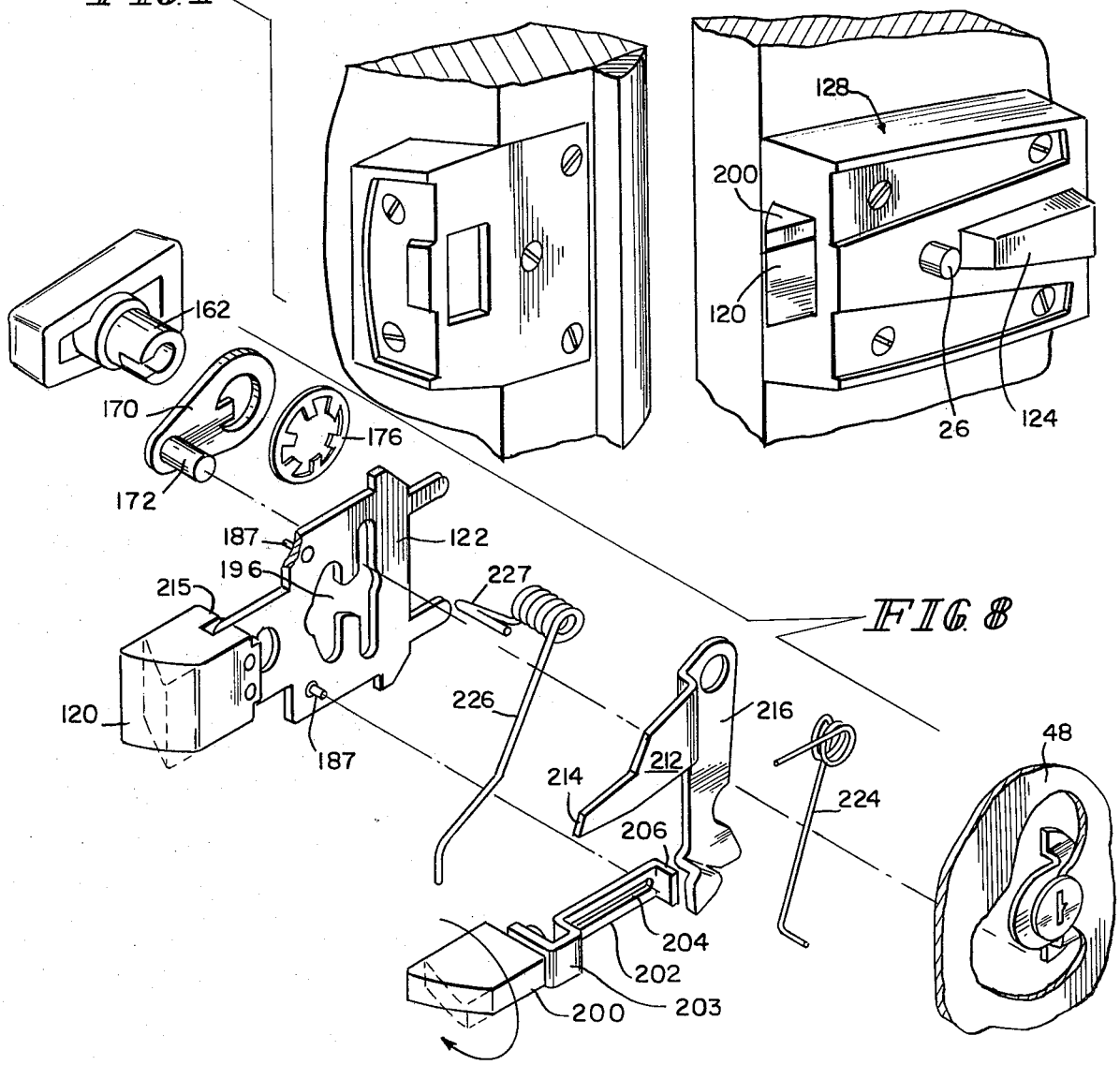
FIG. 8

LATCHBOLT RIM LOCK

This invention relates to rim locks and especially to latchbolt rim locks, with and without a deadlocking auxiliary bolt.

It is the general object of the invention to provide an improved rim lock of simple, sturdy construction which will have smooth and effective operation and a long life.

In accordance with the invention, the rim lock comprises a case which is desirable of die cast construction and has a front face wall, side walls, and front and rear end walls. The case is formed to provide guides for sliding movement of a latchbolt, including a head and draw plate, between a projected locking position and a retracted unlocked position. The rear end wall of the case carries at least one and preferably two U-shaped ribs which define seats for springs which bias the bolt to projected position. The springs are retained in the seats by a rear portion of a back plate on the case. A turnknob mounted by its spindle in the front wall of the case carries a crank arm supporting a crank pin which engages in a cam opening in the draw plate. The cam opening is desirably symmetrical with respect to the center line of the bolt, has a central notch portion which engages the crank pin in forwardly centered position to stop the bolt in projected position, and defines forwardly-presented cam surfaces on opposite sides of such notch. A central throat portion of the cam opening permits the bolt to be cammed rearward with respect to the centered crank pin, and the opening defines supplemental cam surfaces for engagement by the crank pin to move the bolt to release the holdback plunger.

The case forms an inward boss which lies in the path of the bolt head to stop retraction of the bolt, and which contains a manually operable holdback plunger having a headed end which enters a hole in the draw plate to hold the bolt in retracted position.

For deadlocking the latchbolt, an auxiliary bolt is mounted beside the latchbolt and is biased forward, as by a spring mounted on a post die cast in the case. The auxiliary bolt includes a head and a draw bar, and is connected to be retracted with the latchbolt but to be held retracted by a strike while the latchbolt is projected into the strike. A lever pivotally mounted on the case has a blocker arm movable into and out of the path of a portion of the latchbolt to block or permit its retraction and has a control arm operable by the auxiliary bolt to move the blocker arm to a retraction-permitting position when the auxiliary bolt is projected. The lever is biased to blocking position, and when the auxiliary bolt is held retracted, the blocker arm moves to its blocking position to deadlock the latchbolt while the control arm moves against the crank pin so as to be cammed to a retraction-permitting position when the crank pin is manually actuated to retract the bolt. The hand of the lock may be changed by turning the latchbolt to present its bevel in an opposite direction, and by rotating the head of the auxiliary bolt on its draw plate so as to present its bevel face in the same direction as that of the latchbolt.

The accompanying drawings illustrate the invention and show the best mode of carrying out the invention as presently perceived. In such drawings:

FIG. 6 is a longitudinal sectional view taken on the line 6—6 of FIG. 5;

FIG. 7 is a perspective view like FIG. 1 but showing a rim lock having an auxiliary bolt for deadlocking the latchbolt;

FIG. 8 is an exploded view, from the rear of the rim lock shown in FIG. 7, showing the parts which provide the deadlocking function;

Figure 1:
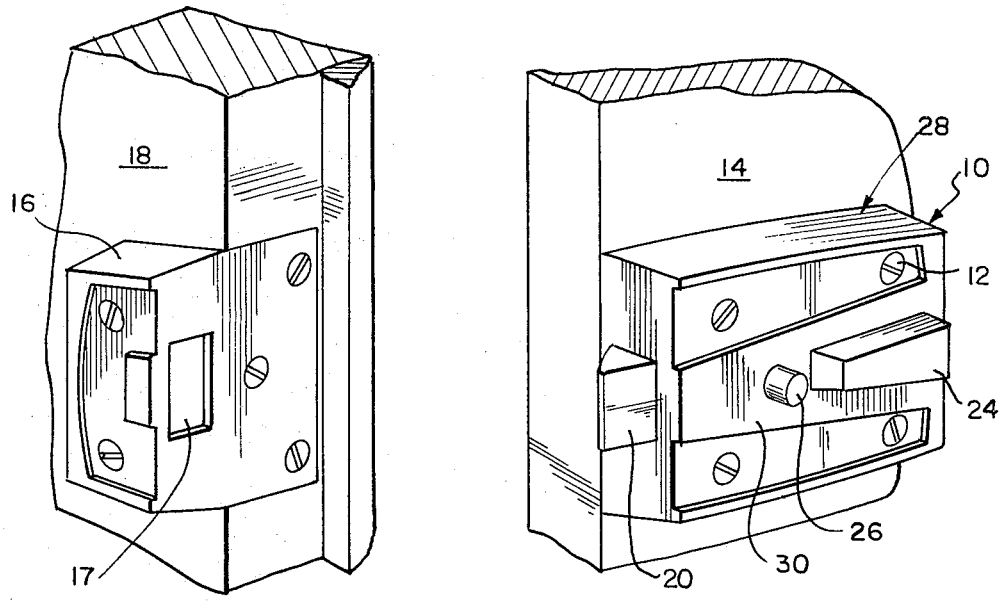
FIG. 1 is a perspective view of a rim lock embodying the invention, shown mounted on a door and in spaced relation with a cooperative strike.

The embodiment shown in FIGS. 1-6 comprises a latchbolt rim lock 10 mounted by screws 12 on the face of a door 14, in cooperative relation with a strike 16 mounted on a doorjamb 18 and having a bolt opening 17. The rim lock 10 has a latchbolt which includes a beveled head 20 and a draw plate 22 to which the head is fixed. The bolt is operated by a turnknob 24 and may be held in retracted position by depressing a holdback button 26. The lock desirably has a die cast case 28 which forms a front face wall 30, two side walls 32, and front and rear end walls 34 and 36. The front end wall is formed with a rectangular bolt opening 38 and the adjacent portion of the front wall 30 is formed with guide ribs 40 which interact with the bolt openings 38 to guide the head of the bolt for sliding movement in the case. A pair of spaced bosses 42 are formed adjacent each side wall 32 intermediate its length, and each has an angular guide groove 44 for guiding the sides of the draw plate 22, and has a projecting hollow stud 46 in position to support a back plate 48 and to receive retaining screws to hold that plate in place. Toward the front of each side wall 32 there is a side rib 50 for supporting the front end of the back plate 48.

The rear wall 36 of the case 28 is formed with two U-shaped ribs 52 which define spring seats 54, the open ends of which are closed by a flange 56 at the rear edge of the back plate 48. See FIG. 6. Adjacent the rear end of each side wall 32 there is a hollow boss 58 forming a reinforced screw hole to receive one of the fastening screws 12. The front wall 30 of the case, rearward of its longitudinal center, is formed with an interior boss 60 which contains a bearing hole for the spindle 62 of the turnknob 24. Forward of such boss 60 there is a second boss 64 which projects into the path of the head 20 of the latchbolt to form a stop which limits retraction movement of the bolt. Such boss 64 is formed at its inner end with a hole to slidably receive the shank of a headed holdback pin 66. The hole is enlarged at its outer end to receive the holdback button 26 which is press-fit on the end of the pin 66, and to receive a spring 68 which biases the holdback plunger to its outward position.

The inner end of the turnknob spindle 62 carries a crank arm 70 having a crank pin 72 at its end, such crank arm is keyed to the spindle by a finger 74, and is held in place by a retainer 76.

The draw plate 22 is formed with parallel side edges 78 which slide on and between the guide faces 44 on the two side bosses 42. Such side edges terminate at the rear at shoulders 80 which move toward the side bosses 42 to provide secondary stops for the forward movement of the bolt. The rear of the draw plate carries two tails 82 which receive the front ends of springs 84 seated in the spring seats 54 for biasing the bolt toward projected position. The draw plate 22 desirably carries a pair of spacer pins 86 adapted to ride along the inner surface of the back plate 48 to hold that back plate in the guides 44.

Figure 2:
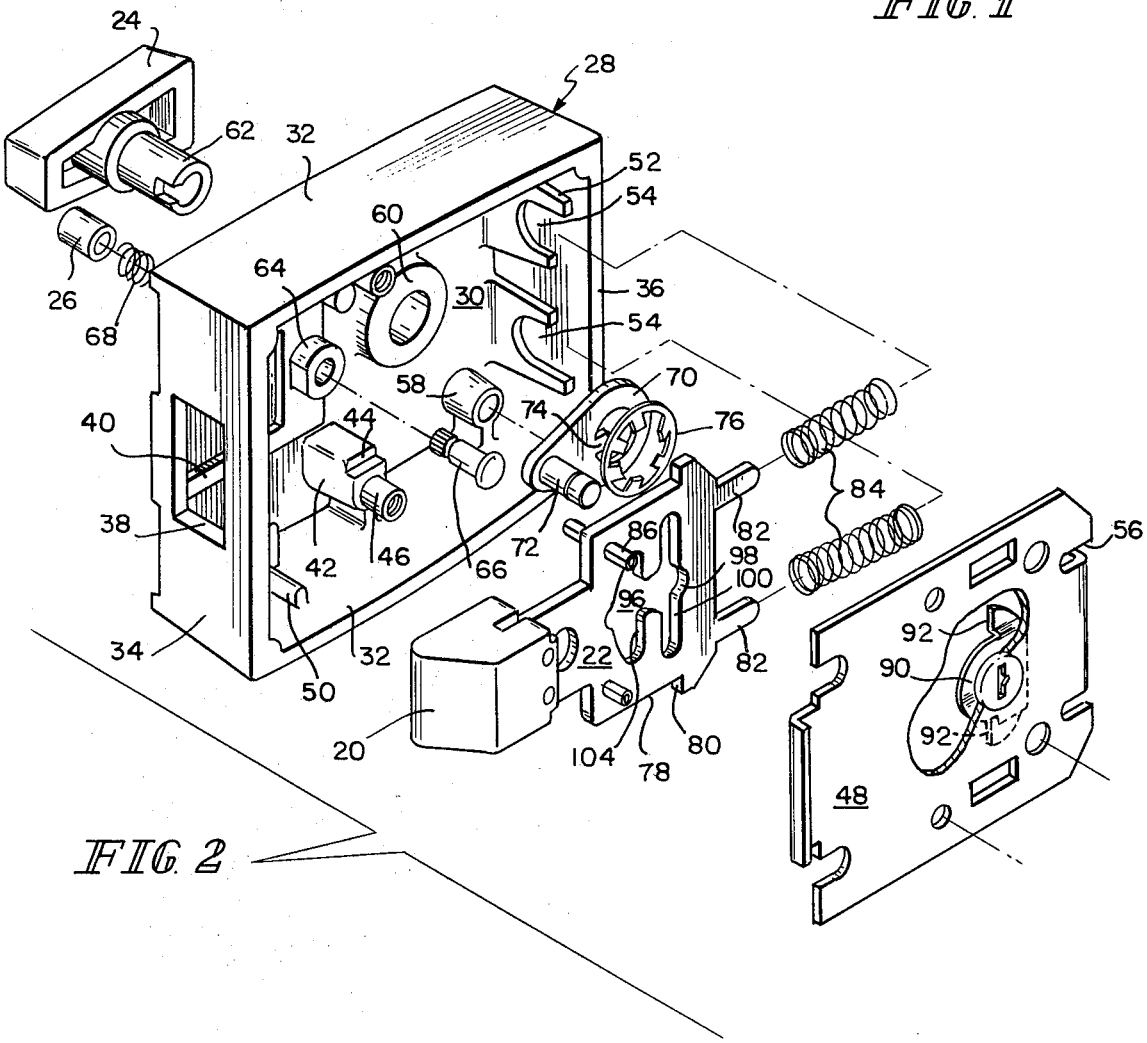
FIG. 2 is an exploded view of the latchbolt rim lock shown in FIG. 1.
Figure 3:
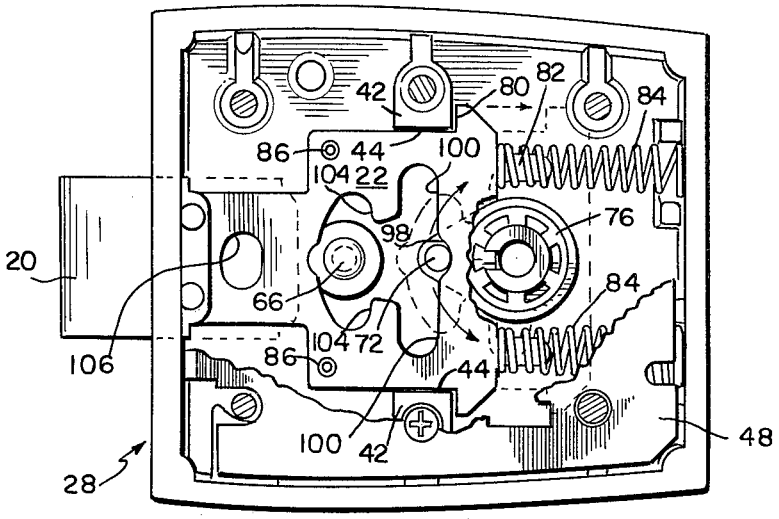
FIG. 3 is a rear elevation of the rim lock shown in FIGS. 1 and 2, with the back plate broken away to show the operating structure, and with the bolt in projected position.
Figure 4:
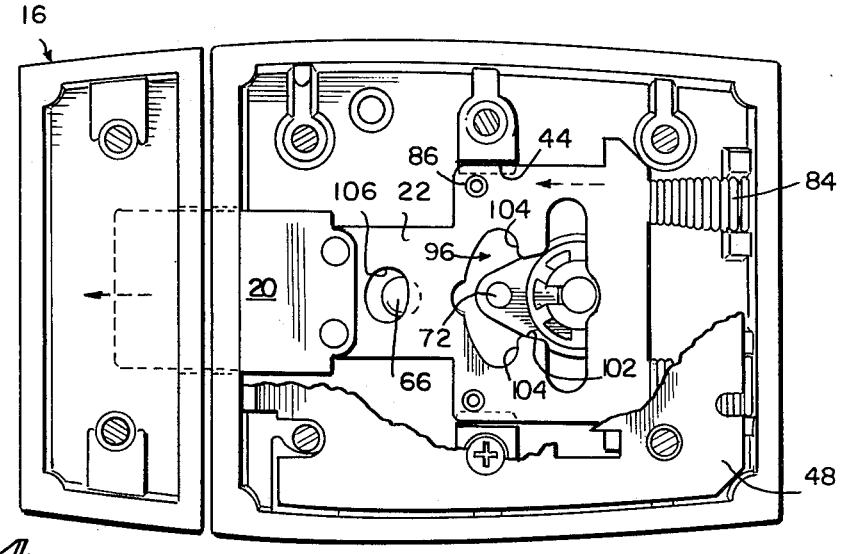
FIG. 4 is a similar rear elevation, showing the bolt cammed rearward by a strike.
Figure 5:
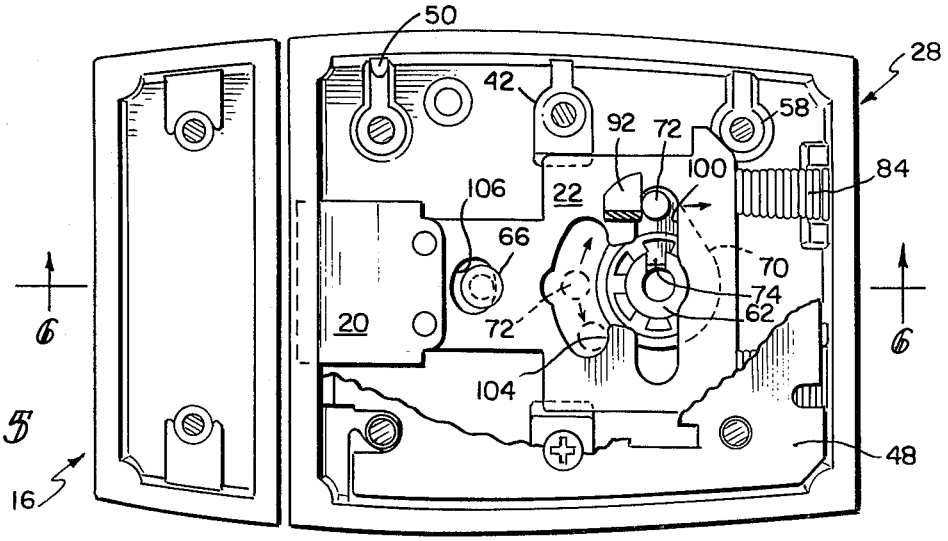
FIG. 5 is a similar rear elevation, showing the bolt held in retracted position by the holdback plunger.

As shown in FIGS. 2 and 3, the draw plate 22 is formed with a cam opening 96. This has a centering notch portion 98 which engages the crank pin 72 as the primary stop for the projected position of the bolt and in which the crank pin 72 is centered when the bolt is projected as in FIG. 3. At opposite sides of such notch, the opening is defined by forwardly presented cam surfaces 100 along which the crank pin 72 may slide as it is rotated to retract the bolt. Forwardly of the centered position of the crank pin 72, the opening has a central throat 102 adapted to pass the centered crank pin 72 when the bolt is cammed rearward as by the strike 16 as shown in FIG. 4. This carries the crank pin 72 into a forward portion of the cam opening, and such portion is provided with laterally extending supplemental cam surfaces 104 in position to be engaged by the crank pin 72 to move it away from heldback position as described below.

The crank pin is operable to retract the bolt either by manual operation of the turnknob 24 or by key actuation of a cylinder 88 mounted in the outer face of the door, as shown in FIG. 6. For such key operation, the back plate 48 is formed with a hole in axial alignment with the spindle bearing hole in the boss 60 of the case, and a cam 90 is rotatably mounted in that opening. The cam carries a pair of oppositely extending fingers 92 in position to engage the projecting end of the crank pin 72. The hub of the cam 90 contains a diametric slot adapted to receive a connecting spade 94 to transmit rotary motion from the key plug of the key-actuated cylinder 88.

For holding the bolt in retracted position, the holdback plunger 26–66 is mounted in the opening defined by the boss 64 of the case, and the draw plate 22 is provided with a holdback opening 106 in position to be entered by the headed rear end of the holdback pin 66 when the bolt is in fully retracted position. When the bolt is then allowed to move forward as biased by the springs 84, the edge of the holdback opening 106 will engage under the head of the holdback pin 66 and such pin will be retained in holdback position, as shown in FIG. 6. To release the holdback, the bolt is moved rearward from its heldback position to disengage the head of the holdback pin 66, and the spring 68 will then retract the holdback plunger away from the draw plate so as to leave the draw plate free for normal projection and retraction movement. This slight rearward holdback release movement may be effected by manual rotation of the turnknob 24. If the crank pin 72 is in the cross slot adjacent the primary cam surfaces 100, as shown in full lines in FIG. 5, the turnknob will be in a vertical position, and slight further rotation of it in a suitable direction will drive the crank pin against the primary cam surface 100 and produce the desired holdback release movement. If the crank pin 72 is in centered position, as shown in full lines in FIG. 4 and in dotted lines in FIG. 5, rotation of the turnknob will carry that crank pin against the supplemental cam faces 104 to drive the draw plate rearward through the necessary rearward release movement.

Operation of the non-deadlocking latch bolt rim lock 10 of FIGS. 1–6 is as follows. In the normal condition of the lock with the latchbolt in projected position, the parts will be in the position shown in FIG. 3, with the bolt 20–22 biased toward projected position by the biasing springs 84. The crank pin 72 will lie in the centering notch 98 of the cam opening and will act as a stop, and the turnknob will thereby be held in its normal horizontal position as shown in FIG. 1. Manual rotation of the turnknob 24 in either direction from this position will carry the crank pin 72 out of its notch 98 and along one of the primary cam surfaces 100, and the arcuate movement of the crank pin will retract the bolt. Accordingly, if the bolt head 20 is engaged in the strike 16, this rotation of the turnknob will release the bolt from the strike and allow the door to be opened. When the turnknob 24 is released, with the door open, the biasing springs 84 will again press the bolt forward, and this will cause the crank pin to return to the centering notch 98 and cause the turnknob to return to its normal centered position.

If the door is now closed, the beveled face of the bolt head 20 will engage the strike and the bolt will be cammed rearward to the position shown in full lines in FIG. 4. In this rearward movement of the bolt, the crank pin 72 may remain in centered position, and the relative movement of the bolt will carry it through the throat 102 of the cam opening to the position shown in FIG. 4. When the head of the bolt reaches the keeper opening 17 of the strike 16, the bolt will be again moved forward to its projected position by the biasing springs 84, and the door will be locked.

If it is desired to hold the bolt 20–22 in retracted position, the bolt is retracted either by rotating the turnknob 24 as described above or by manually pushing on the bolt head 20. Meanwhile, the holdback button 26 is manually pushed inward, and when the movement of the bolt carries the holdback opening 106 into alignment with the holdback pin 66, that pin will pass through that opening. The bolt is then allowed to move forward against the shank of the holdback pin 66 and beneath its head, to the position shown in FIGS. 5 and 6. The holdback plunger will then be latched in holdback position by engagement of its head with the edge of the holdback opening, and the bolt will be held in retracted position. To release it from that position, it is only necessary to retract the bolt sufficiently to release the head of the holdback pin from engagement with the draw plate, and the biasing spring 68 will then retract the holdback plunger and release the bolt for normal operation.

The modified rim lock of FIGS. 7–11 provides for deadlocking its latchbolt. The rim lock of FIGS. 7–11 comprises a case 128 fitted with a turnknob 124 having a spindle 162 which carries a crank arm 170 held in place by a retainer 176 and carrying a crank pin 172, all of which parts are the same as those in the modification of FIGS. 1–6. The crank pin 172 operates a latchbolt having a head 120 and a draw plate 122 provided with a cam opening 196. The latchbolt is identical with that of the previous modification, and is similarly mounted and operated, except only that instead of the spacer pins 86 of the previous modification, the draw plate 122 carries retraction pins 187 projecting in opposite directions from such draw plate, for purposes described below.

An auxiliary latchbolt 200 is mounted against one edge face of the latchbolt head 120 and is rotatably connected to a draw bar 202 having a longitudinal slot 204 and a rear upstanding finger 206. The draw bar is engaged over one or the other of the retraction pins 187 of the draw plate 122, depending upon the orientation of that draw plate, so as to form a lost-motion connection by which the auxiliary bolt 200–202 will be pulled rearward with the latchbolt 120–122 but can be held retracted while the latchbolt is projected. The latchbolt is reversibile to orient its beveled face in opposite directions, and the head 200 of the auxiliary latchbolt is similarly reversible by rotation on its draw bar 202. The provision of two oppositely disposed retraction pins 187 provides a retraction pin in both orientations and allows the draw bar 202 to remain in the same orientation in both cases.

Figure 9:
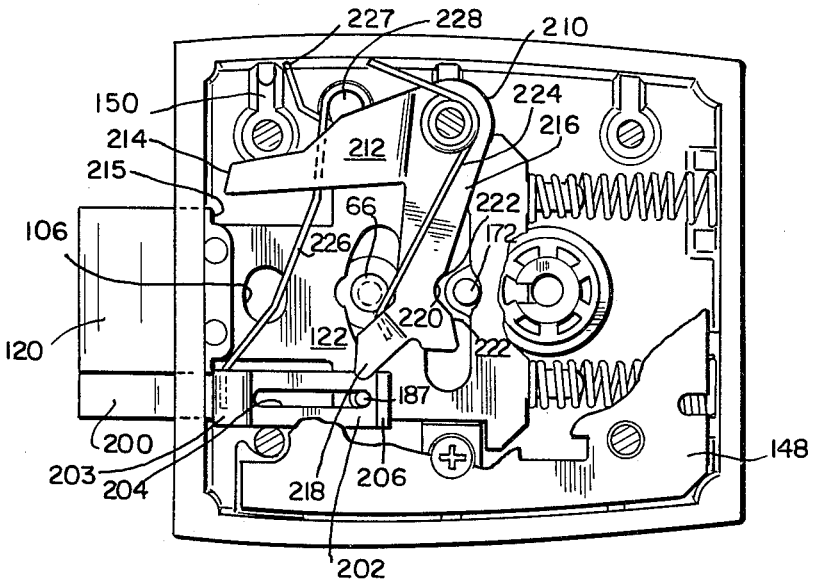
FIG. 9 is a rear elevation of the deadlocking latchbolt rim lock of FIGS. 7 and 8, showing the bolts in projected position.
Figure 11:
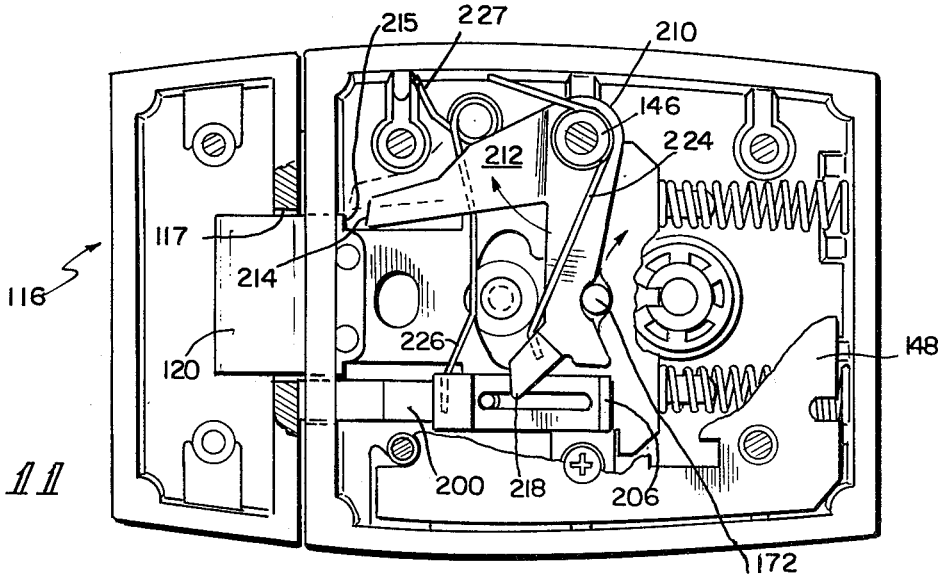
FIG. 11 is a similar rear elevation, showing the parts in deadlocking position.

A bell crank lever 210 is mounted on a post 146 formed in the case as part of a boss 142 like the boss 42 in FIGS. 2–5. The lever 210 has a blocker arm 212 which projects forward alongside the bolt and is movable to a bolt-blocking position in which its forward end 214 lies in the path of a rear shoulder 215 on the latchbolt head 120 to block its retraction, as shown in full lines in FIG. 11, and also to a retraction-permitting position out of that path, as shown in full lines in FIG. 9. The lever 210 also has a control arm 216, integral with the blocker arm 212, and extending across the face of the draw plate 122. The control arm has a cam nose 218 at its end, in position to be engaged by the finger 206 of the draw bar 202 of the auxiliary bolt 200, and the relationship is such that when the auxiliary bolt is projected as shown in FIG. 9, the finger 206 actuates the cam nose 218 to rotate the lever to a retraction-permitting position. The control arm 216 also has a cam notch 220 with camming faces 222 extending in opposite directions therefrom, in position to engage the crank pin 172 when the control arm is released from the draw bar 202 and the lever moves to its deadlocking position as shown in FIG. 11. The control arm 216 is biased toward the crank pin 172 by a cam lever spring 224 and the blocker arm is thereby biased to its deadlocking position. The auxiliary bolt 200–202 is biased forward by a somewhat heavier latch control spring 226, mounted on a spring support post 228 formed in the casing. The fixed end 227 of such spring is anchored between the side wall of the case and a boss 150 formed in the case, and the free end of the spring extends across the face of the draw plate and into engagement with an offset portion 203 of the draw bar 202, behind the latchbolt head 120.

Figure 10:
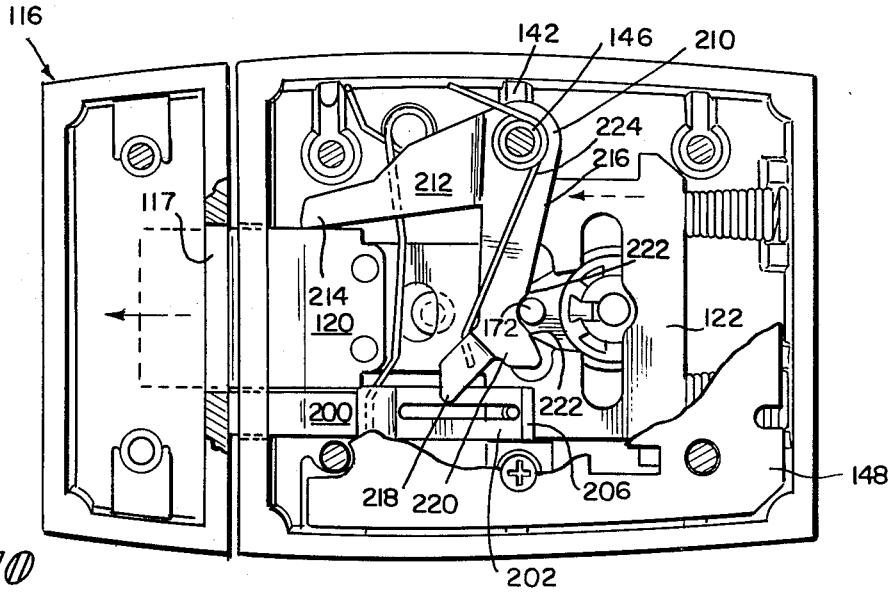
FIG. 10 is a similar rear elevation showing the bolts both cammed rearward by a strike.

The rim lock having deadlocking mechanism is adapted to be used with a strike 116 which contains a keeper opening 117 which will pass the head 120 of the latchbolt but will not pass the head 200 of the auxiliary bolt, as shown in FIGS. 10 and 11. Accordingly, when the rim lock is closed with a strike 116, the latchbolt 120 will project through the opening 117 into the strike 116, while the auxiliary bolt head 200 will be held retracted, as shown in FIG. 11. This modification is provided with holdback mechanism like that in FIGS. 1–6. Thus, the holdback plunger 26, 66 is mounted in the front wall of the case, and the draw plate 122 is provided with a holdback opening 106, as in FIGS. 1–6.

Operation of the rim lock having a deadlocking function as described is as follows. With the lock in normal door-open position, shown in FIG. 9, both the latchbolt head 120 and the auxiliary bolt head 200 will be in projected positions, and the finger 206 at the rear of the draw bar 202 of the auxiliary latchbolt will be in engagement with the cam nose 218 of the control arm 216 of the lever 210, and will pivot that control arm and the blocker arm 212 clockwise so that the end 214 of the locker arm 212 will be held well out of the path of retraction movement of the latchbolt head 120. If the lock is now closed against a strike 216, both the latchbolt head 120 and the auxiliary bolt head 200 will be cammed to a retracted position, as shown in FIG. 10. As such cammed retraction begins, the timing is such that the rear shoulder 215 of the latchbolt will be carried past the end 214 of the blocker arm 212 before the draw bar of the auxiliary bolt releases the cam nose 218 sufficiently to allow that blocker arm to block retraction movement. The end 214 of the blocker arm will then move against and ride along the side face of the latchbolt head 120, so that no blocking action will occur, and the parts will be free to move to the position shown in FIG. 10. When the lock reaches fully closed position, the latchbolt head 120 will be projected through the keeper opening 117 of the strike, as shown in dotted lines in FIG. 10, but the auxiliary bolt 200 will be held retracted by the front wall of the strike 116. With that auxiliary bolt held retracted, its draw bar finger 206 will be held away from the cam nose 218 of the control arm, and the lever 210 will be rotated by its spring 224 to carry its cam notch 220 against the crank pin 172, and the blocker arm 212 will move to its blocking position as shown in full lines in FIG. 11. It will then lie in the path of retraction movement of the shoulder 215 of the latchbolt head 120, and the latchbolt will be deadlocked against forced retraction.

If the deadlocked latchbolt is now retracted by manual operation of the turnknob 124, or by key actuation of a cylinder corresponding to the cylinder 88 of FIGS. 1–6, such actuation will carry the crank pin 172 away from its centered position along one of the cam faces 222 on the control arm, and will move that cam arm and the blocker arm 212 together to carry the blocker arm to a retraction-permitting position as shown in dotted lines in FIG. 11, and further swinging movement of the crank pin 172 will then be effective to retract the bolt 120–122 past the end of the blocker arm 212 in the same manner as in the modification of FIGS. 1–6. If it is desired to latch the bolt in retracted position, the latchbolt 120–122 is retracted either by actuation of the turnknob 124 or by manually pushing inward on the head 120 of the latchbolt. The auxiliary bolt 200, connected to the draw bar by engagement of the retraction pin 187 in the slot 204 of the draw bar 202, will be retracted with the latchbolt. When the bolts have been retracted to a position in which the holdback opening 106 of the draw plate 222 is aligned with the holdback plunger 66, the holdback button 26 is depressed to carry the headed pin of that plunger through that opening, and held while the bolt is allowed to move forward slightly to engage under the head of the pin to retain it in holdback position. The holdback plunger is released by slightly retracting the bolt to disengage the draw bar from the head of that plunger, as described in connection with the previous modification.

If it is desired to change the hand of the rim lock, this may be accomplished with the modification of FIGS.

1–6 by removing the back plate 48, and by removing the latchbolt 20–22 and replacing it with its beveled face oriented in the opposite direction. In the case of the modification of FIGS. 7–11, such change of hand can be accomplished by removing the back plate 148 and removing the lever 210 and the springs 224 and 226 to expose the latchbolt and the auxiliary bolt. These are then removed, the latchbolt 120–122 is then reinstalled in opposite orientation, as indicated in dotted lines in FIG. 8. The head 200 of the auxiliary bolt is then rotated 180° with respect to its draw bar 202, as indicated in dotted lines in FIG. 8, and the auxiliary bolt is then reinstalled with its draw bar slot engaged over the retraction pin 187 which is now presented for that engagement on the newly installed draw plate 122. The springs 224 and 226 and lever 210 are then reinstalled, and the case closed with the back plate 148.

We claim:

1. A rim lock, comprising a case having a front wall and side and end walls, a latchbolt including a head and a draw plate, slidably mounted in the case for movement between a projected locking position and a retracted unlocked position, said draw plate having laterally spaced spring seats at its rear end, said case having two laterally spaced spring seats formed in its rear end wall, a spring mounted between each spring seat and the rear end of the draw plate and biasing the bolt forward to projected position, said draw plate having a cam opening therein ahead of said spring seats defining a forwardly presented cam surface, a crank rotatably mounted in the front wall between the positions of the spaced springs, and having a forwardly offset crank pin engaged in said cam opening and movable against the cam surface to move the bolt to retracted position.

2. A rim lock as in claim 1 with the addition of a boss formed on the front wall of the case and projecting into the path of the head of the bolt as a stop to limit its retracting movement, a holdback plunger mounted for axial movement in said boss, a holdback opening in said draw plate in position to be entered by said holdback plunger when the bolt is retracted, said plunger having a front button adapted to be manually depressed to engage the holdback plunger, a biasing spring behind the button, and a rearward-extending stem having a rear headed end adapted to pass through the holdback opening of the retracted bolt and to hook over the edge of the holdback opening to retain engagement of the plunger with the draw plate to hold the draw plate in retracted position.

3. A rim lock comprising a case having a front wall and side and end walls, a latchbolt including a head and a draw plate, slidably mounted in the case for movement between a projected locking position and a retracted unlocked position, said case having at least one spring seat formed in its rear end wall, a spring mounted between said spring seat and the rear end of the draw plate and biasing the bolt forward to projected position, said draw plate having a cam opening therein defining a forwardly presented cam surface, a crank rotatably mounted in the front wall and having a crank pin engaged in said cam opening and movable against the cam surface to move the bolt to retracted position, a holdback opening in said draw plate, and a holdback plunger mounted for axial movement in the front wall of the case in position to enter the holdback opening when the bolt is retracted, said plunger having a front button adapted to be manually depressed to engage the holdback plunger, and having a rear headed end adapted to enter the holdback opening of the retracted bolt and to hook over the edge of the holdback opening to retain engagement of the plunger with the draw plate to hold the draw plate in retracted position, said cam opening having at the rear a central notch portion which seats against the crank pin when the bolt is projected, so that such crank pin is centered thereby and acts as a stop to limit forward movement of the bolt and determine the projected position thereof, the cam opening having a cross slot defined by forwardly presented cam faces on both sides of said central notch so that the bolt will be retracted by rotation of the crank in either direction from said centered position, the cam opening also having a forwardly-extending central throat portion to pass the centered crank pin and having supplemental cam faces adjacent the forward end of such throat for engagement by the crank pin when the bolt is in heldback position for retracting the bolt sufficiently to release the headed end of the holdback plunger from its engagement with the edge of the holdback opening, the holdback plunger being biased so as to move to bolt-releasing position when its head is so released.

4. A rim lock, comprising a die cast case having a front wall, opposite side walls, a front end wall having a bolt opening, and a rear end wall, said front end wall and the adjacent front wall being formed with guide surfaces defining the bolt opening and for guiding the head of a bolt for sliding movement, bosses formed within the walls for defining guides for guiding a draw plate connected to a bolt head, and defining support surfaces for supporting a back plate, a pair of laterally spaced U-shaped ribs formed on the rear end wall and opening toward the open rear of the case, defining a pair of spring seats facing toward the front end wall for the reception of bolt-biasing springs between such seats and the draw plate, a crank bearing in the front wall of the case, centrally between the positions of the spring seats, for mounting a bolt operating crank in the case, and a back plate supported on said support surfaces and having a rear edge portion for closing the open ends of said U-shaped ribs to retain the springs in the seats formed by such ribs, a latch bolt including a head slidable through said bolt opening and a draw plate slidable in said draw plate guides, said draw plate having a pair of spring receptacles at its rear end, and a pair of springs mounted between said seats and receptacles, said draw plate having a cam opening therein defining a retraction cam face, and a crank mounted in said crank bearing laterally between the positions of said springs, and having a forwardly offset crank pin projecting into said cam opening and movable against said cam face to retract the bolt, a boss on the front wall of the case forming a stop in the path of the bolt head to stop it in retracted position, a holdback plunger mounted for axial movement in said boss, and a holdback opening in the draw plate in position to be engaged by the plunger to hold the bolt retracted.

5. A rim lock as in claim 4, in combination with a latch bolt including a head slidable through said bolt opening and a draw plate slidable in said draw plate guides, said draw plate having a pair of spring receptacles at its rear end, and a pair of springs mounted between said seats and receptacles, said draw plate having a cam opening therein defining a retraction cam face, and a crank mounted in said crank bearing opening and having a crank pin projecting into said cam opening and movable against said cam face to retract the bolt.

6. A rim lock as in claim 5 with the addition of a boss on the front wall of the case forming a stop in the path of the bolt head to stop it in retracted position, a holdback plunger in said boss, and a holdback opening in the draw plate in position to be engaged by the plunger to hold the bolt retracted.

7. A rim lock as in claim 4 which includes a pivot support on the case for a deadlocking lever and a spring support for an auxiliary bolt spring, an auxiliary bolt mounted for movement adjacent one side of the latchbolt and connected for retraction therewith but adapted to remain retracted when held by a strike while the latchbolt is projected, an auxiliary bolt spring mounted on said spring support and biasing the auxiliary bolt toward projected position, a lever mounted on said pivot support, having a blocker arm along the opposite side of the latch bolt from the auxiliary bolt and movable between a bolt-retraction blocking position and a bolt-retraction-permitting position, and having a control arm extending across the face of the draw plate into operative relation with the auxiliary bolt and operable by said auxiliary bolt to move the blocker arm to retraction-permitting position when the auxiliary bolt is projected.

8. A rim lock, comprising a case, and a latchbolt mounted in the case for movement between projected and retracted positions and biased toward projected position, said latchbolt including a draw plate, an auxiliary bolt mounted adjacent the latchbolt for movement between projected and retracted positions, connected for retraction with the latchbolt and adapted to be held retracted by a strike while the latchbolt is projected into the strike, a lever pivoted on the case, having a blocker arm extending along one side of the draw plate and movable between a retraction-blocking position in which it deadlocks the latchbolt and a latchbolt retraction-permitting position, means actuated by the said auxiliary bolt to position the blocker arm in retraction-permitting position when the auxiliary bolt is projected so as to permit both bolts to be retracted together by a strike, means to position the lever in deadlocking position when the auxiliary bolt is held retracted as by a strike while the latchbolt is projected, manually operable means for retracting the latchbolt, said means being laterally displaced from said blocker arm and having a normal position from which it moves to retract the latchbolt, a control arm on said lever extending laterally of the latchbolt into operative relation with said manually operable means and having a cam portion which lies in the path of movement of said manually operable means when the lever is in a deadlocking position so as to be actuated during initial movement of said means from normal position for moving the lever to a bolt-retraction-permitting position.

9. A rim lock as in claim 8 wherein the auxiliary bolt is at one side of the latchbolt and has a control actuating finger at the rear, said lever is pivotally mounted at the opposite side of the latchbolt and rearward of its head, the blocker arm extends forward and is swingable into the path of a portion of the bolt to block retraction of the bolt and out of such path to permit retraction of the bolt, and said control arm extends across the latchbolt and into the path of the actuating finger so as to be moved thereby to move the blocker arm to its retraction-permitting position when the auxiliary bolt is projected.

10. A rim lock as in claim 8 in which said latchbolt is symmetrical so as to be reversible to change the hand of the lock, said auxiliary bolt comprising a head rotatably mounted on a draw bar and rotatable thereon so as to reverse its orientation to match that of the latchbolt.

11. A rim lock comprising a case, and a latchbolt mounted in the case for movement between projected and retracted positions and biased toward projected position, an auxiliary bolt mounted adjacent the latchbolt for movement between projected and retracted positions, connected for retraction with the latchbolt and adapted to be held retracted by a strike while the latchbolt is projected into the strike, a lever pivoted on the case, having a blocker arm movable between a retraction-blocking position in which it deadlocks the latchbolt and a latchbolt retraction-permitting position, and means actuated by the said auxiliary bolt to position the blocker arm in retraction-permitting position when the auxiliary bolt is projected so as to permit both bolts to be retracted together by a strike, means forming a forwardly-presented cam face on the latchbolt, a crank arm rotatable in the case and having a crank pin thereon, the crank pin having a normal position when the latchbolt is projected and being movable therefrom against said cam face to retract the bolt, a control arm on said lever having a cam portion which lies in the path of the crank pin when the lever is in deadlocking position so as to be engaged during initial movement of the crank pin from normal position for moving the lever to a bolt-retraction-permitting position.

12. A rim lock comprising a case, and a latchbolt mounted in the case for movement between projected and retracted positions and biased toward projected position, an auxiliary bolt mounted adjacent the latchbolt for movement between projected and retracted positions, connected for retraction with the latchbolt and adapted to be held retracted by a strike while the latchbolt is projected into the strike, a lever pivoted on the case, having a blocker arm movable between a retraction-blocking position in which it deadlocks the latchbolt and a latchbolt retraction-permitting position, and means actuated by the said auxiliary bolt to move the blocker arm to retraction-permitting position when the auxiliary bolt is projected so as to permit both bolts to be retracted together by a strike, the auxiliary bolt being at one side of the latchbolt and having a control actuating finger at the rear, said lever being pivotally mounted at the opposite side of the latchbolt and rearward of its head, the blocker arm extending forward and being swingable into the path of a portion of the bolt to block retraction of the bolt and out of such path to permit retraction of the bolt, and said lever having a control arm extending into the path of the actuating finger so as to be moved thereby to move the blocker arm to its retraction-permitting position when the auxiliary bolt is projected, a crank arm rotatable in the case and having a crank pin thereon, means forming on the latchbolt a centering notch which seats against the crank pin to center the same in a normal position when the bolt is projected, cam faces adjacent said notch against which the crank pin is movable to retract the bolt, said control arm having a cam portion which lies adjacent the normally-positioned crank pin when the lever is in deadlocking position, such cam portion being actuated during initial movement of the crank pin from normal position for moving the lever to a bolt-retraction-permitting position.

13. A rim lock, comprising a case and a latchbolt mounted in the case for movement between projected and retracted positions, said latchbolt including a beveled head and a central draw plate of symmetrical shape so that the bolt is reversible to change the orientation of the beveled bolt head, an auxiliary bolt including a beveled head and a draw bar, said auxiliary bolt being mounted with its head adjacent the latchbolt head and with its draw bar extending along a face of the draw bar in the same relation to the case in both orientations of the latchbolt, the auxiliary bolt head being rotatable on the draw bar to reverse the orientation of its bevel to match that of the latchbolt head.

14. A rim lock comprising a case having a front wall, a latchbolt including a beveled head and a draw plate, slidably mounted in the case for movement between a projected locking position and a retracted unlocked position, and biased to projected position, manually operable means for retracting the bolt, said draw plate having a cam opening therein defining a forwardly presented cam surface, a crank rotatably mounted in the front wall and having a crank pin engaged in said cam opening and movable against the cam surface to move the bolt to retracted position, manually operable holdback means mounted in the case and movable into operative relation with the bolt to retain the bolt in retracted position, said latchbolt being symmetrical with respect to a longitudinal center line so as to be reversed in the case to change the hand of the lock, and the said holdback means being operable with the bolt in either hand position, with the addition of an auxiliary bolt mounted against one edge face of the symmetric latchbolt, and a deadlocking lever for said auxiliary latchbolt having a deadlocking arm disposed at the opposite side of the latchbolt from said edge face and a control arm extending across the face of the draw plate in operative relation with the latchbolt retraction means and with the auxiliary latchbolt.

15. A rim lock, comprising a case having a front wall, a latchbolt including a head and a draw plate, slidably mounted in the case for movement between a projected locking position and a retracted unlocked position, said draw plate having a cam opening therein defining a forwardly presented cam surface, a crank rotatably mounted in the front wall and having a crank pin engaged in said cam opening and movable against the cam surface to move the bolt to retracted position, a manually operable holdback mounted in the case and movable into latched engagement with the bolt when the bolt is retracted, to retain the bolt in a retracted position , said holdback being biased to disengaged position and being releasable from bolt engagement by retraction of the bolt from said retained position, said cam opening being defined at the rear by a central notch portion which seats against the crank pin when the bolt is projected, so that such crank pin is centered thereby and acts as a stop to limit forward movement of the bolt and determine the projected position thereof, the cam opening having a cross slot defined by forwardly presented cam faces on both sides of said central notch so that the bolt will be retracted by rotation of the crank in either direction from said centered position, the cam opening also having a forwardly extending central throat portion to pass the centered crank pin and having supplemental cam faces adjacent the forward end of such throat for engagement by the crank pin when the bolt is in heldback position for retracting the bolt sufficiently to release the holdback from its latched engagement with the bolt.

16. A rim lock, comprising a case having a front wall, a latchbolt including a head and a draw plate, slidably mounted in the case for movement between a projected locking position and a retracted unlocked position, said draw plate having a cam opening therein defining a forwardly presented cam surface, a crank rotatably mounted in the front wall and having a crank pin engaged in said cam opening and movable against the cam surface to move the bolt to retracted position, a manually operable holdback mounted in the case and movable into latched engagement with the bolt when the bolt is retracted, to retain the bolt in a retracted position, said holdback being biased to disengaged position and being releasable from bolt engagement by retracton of the bolt from said retained position, said cam opening being defined at the rear by a crank pin receiving portion in which the crank pin is normally positioned when the bolt is in projected position, the cam opening having a cross slot defined by a forwardly presented cam face on at least one side of said pin-receiving portion so that the bolt will be retracted by rotation of the crank from said normal position, the cam opening also having a forwardly extending throat portion to pass the so-positioned crank pin and having a supplemental cam face adjacent the forward end of such throat for engagement by the crank pin when the bolt is in heldback position for retracting the bolt sufficiently to release the holdback from its latched engagement with the bolt and thereby allow the bolt to move to projected position when the crank pin is returned to said throat portion.

* * * * *